US012607430B2

(12) United States Patent
Porat

(10) Patent No.: US 12,607,430 B2
(45) Date of Patent: Apr. 21, 2026

(54) PISTOL STABILIZER PLATFORM

(71) Applicant: RT Recover Innovations Ltd., Tel Aviv (IL)

(72) Inventor: Tamir Porat, Tel Aviv (IL)

(73) Assignee: RT Recover Innovations Ltd., Tel Aviv (IL)

( * ) Notice: Subject to any disclaimer, the term of this patent is extended or adjusted under 35 U.S.C. 154(b) by 0 days.

(21) Appl. No.: 18/915,610

(22) Filed: Oct. 15, 2024

(65) Prior Publication Data

US 2026/0104230 A1 Apr. 16, 2026

(51) Int. Cl.
*F41C 23/12* (2006.01)
*F41C 23/14* (2006.01)

(52) U.S. Cl.
CPC ..... *F41C 23/12* (2013.01); *F41C 23/14* (2013.01)

(58) Field of Classification Search
CPC ..... F41C 23/12; F41C 23/14
See application file for complete search history.

(56) References Cited

U.S. PATENT DOCUMENTS 3,685,194 A * 8/1972 Coon ..... F41C 23/10 42/72
4,677,781 A * 7/1987 Lee ..... F41A 17/22 42/72
6,318,014 B1 * 11/2001 Porter ..... F41C 23/12 42/71.01
7,437,847 B1 * 10/2008 Mabry ..... F41C 23/04 42/73
7,552,557 B1 * 6/2009 Mabry ..... F41A 11/04 42/71.01
8,448,366 B2 * 5/2013 Faifer ..... F41G 11/003 42/72
8,887,432 B2 * 11/2014 Oz ..... F41C 23/12 42/71.01
9,109,856 B1 * 8/2015 Zamlinsky ..... F41A 11/02
10,161,709 B1 * 12/2018 Wright ..... F41C 7/00
10,551,142 B1 * 2/2020 Wright ..... F41A 19/183
10,627,189 B2 * 4/2020 Faifer ..... F41C 33/001
10,871,345 B2 * 12/2020 Faifer ..... F41C 33/001
11,118,860 B2 * 9/2021 Zimmer ..... F41A 35/02
11,460,267 B2 * 10/2022 Faifer ..... F41A 3/72
11,573,064 B1 * 2/2023 Siepman ..... F41C 3/00
11,592,262 B2 * 2/2023 Porat ..... F41C 23/04
11,692,790 B2 * 7/2023 Porat ..... F41C 23/12 42/69.02
11,719,501 B2 * 8/2023 Ames ..... F41A 21/36 42/75.01
12,000,671 B2 * 6/2024 Kielsmeier ..... F41C 9/02
12,066,271 B2 * 8/2024 Porat ..... F41G 1/06
2009/0282718 A1 * 11/2009 Bartley ..... F41C 23/12 42/75.03

(Continued)

*Primary Examiner* — Michelle Clement
(74) *Attorney, Agent, or Firm* — Heidi Brun Associates Ltd.; Heidi M. Brun

(57) ABSTRACT

A pistol stabilizer platform includes a platform member including multiple mounting provisions, a forward handgun clasping assembly secured to the platform member at a first one of the multiple mounting provisions, and a rear grip abutment member secured to the platform member at a second one of the multiple mounting provisions. The platform member is located only on one side of the handgun placed in the pistol stabilizer platform.

10 Claims, 6 Drawing Sheets

(56) References Cited

U.S. PATENT DOCUMENTS

| | | | | |
|---|---|---|---|---|
| 2012/0131829 | A1* | 5/2012 | Fistikchi | F41C 23/22 42/1.06 |
| 2014/0360076 | A1* | 12/2014 | Zamlinsky | F41C 23/20 42/75.03 |
| 2015/0316339 | A1* | 11/2015 | Young | F41A 35/06 42/49.01 |
| 2015/0316346 | A1* | 11/2015 | Brandt | F41C 23/12 42/71.02 |
| 2019/0226798 | A1* | 7/2019 | Faifer | F41C 33/001 |
| 2019/0323795 | A1* | 10/2019 | Zimmer | F41G 11/001 |
| 2021/0116209 | A1* | 4/2021 | Faifer | F41A 3/72 |
| 2023/0081853 | A1* | 3/2023 | Butler | F41C 27/00 42/72 |
| 2023/0132043 | A1* | 4/2023 | Porat | F41C 23/12 42/69.02 |

* cited by examiner

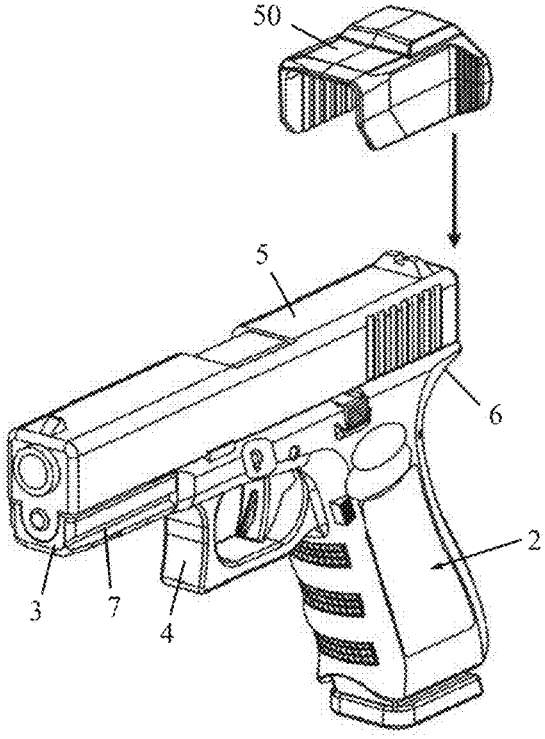
FIG. 4A
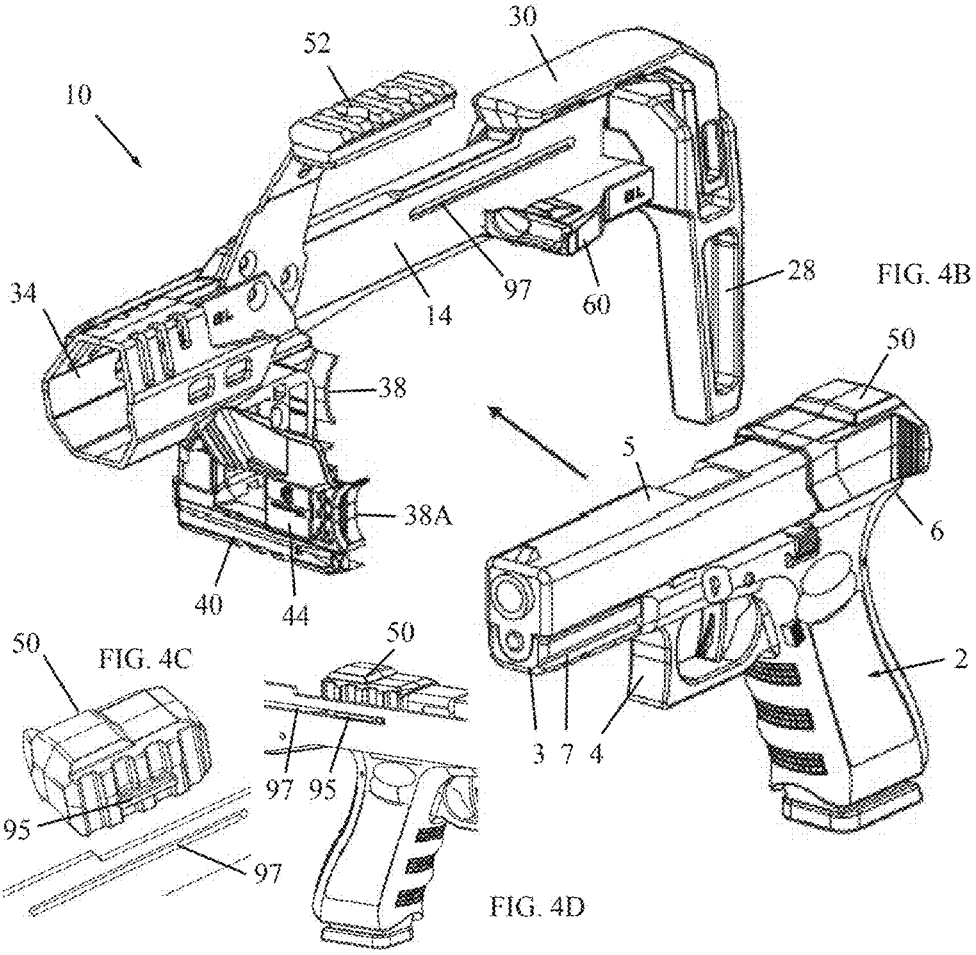
FIG. 4B
FIG. 4C
FIG. 4D

PISTOL STABILIZER PLATFORM

FIELD OF THE INVENTION

The present invention relates to firearms in general and in particular to a pistol stabilizer platform.

BACKGROUND OF THE INVENTION

Handguns normally are held in one hand while they are being aimed and fired, and that hand may be steadied by the other hand of the shooter or a two-handed grip.

A number of devices designed to attach to a handgun to aid a user in holding or stabilizing the handgun are well known, such as pistol stabilizer. One example of such a stabilizer has a brace having wraps or bands that wrap around the shooter's forearm. Another example uses a vertical stabilizing fin that rests against the inside of the forearm to stabilize an attached handgun during firing. Stabilizers can also have a stock which serves as a buttstock.

SUMMARY

The present invention seeks to provide a pistol stabilizer platform, as is described hereinbelow.

There is thus provided in accordance with a non-limiting embodiment of the present invention a pistol stabilizer platform including a platform member including multiple mounting provisions, a forward handgun clasping assembly secured to the platform member at a first one of the multiple mounting provisions, the forward handgun clasping assembly being configured to secure a forward portion of a handgun placed in the pistol stabilizer platform and to abut against a trigger guard of the handgun, and a rear grip abutment member secured to the platform member at a second one of the multiple mounting provisions, the rear grip abutment member being configured to secure a rear portion of the handgun placed in the pistol stabilizer platform, and wherein the platform member is located only on one side of the handgun placed in the pistol stabilizer platform.

In accordance with a non-limiting embodiment of the present invention the forward handgun clasping assembly and the rear grip abutment member are movable to different positions among the multiple mounting provisions to accommodate different models of handguns.

In accordance with a non-limiting embodiment of the present invention the forward handgun clasping assembly and the rear grip abutment member are parts of an assortment of different forward handgun clasping assemblies and rear grip abutment members structured to accommodate different models of handguns.

In accordance with a non-limiting embodiment of the present invention an extendable rear buttstock rail is arranged to slide in a channel. The channel may be bounded on one side by the handguard member and on an opposite side thereof by the platform member.

In accordance with a non-limiting embodiment of the present invention a forward handgun guard member is secured to the platform member and configured to receive a portion of a slide or barrel of the handgun.

In accordance with a non-limiting embodiment of the present invention a charging handle accessory is provided for attachment to a slide of the handgun. The charging handle accessory may have a side projection received in a longitudinal groove formed in the platform member.

In accordance with a non-limiting embodiment of the present invention a firearms accessories rail member is secured to a flange which is secured to the platform member.

BRIEF DESCRIPTION OF DRAWINGS

The present invention will be understood and appreciated more fully from the following detailed description taken in conjunction with the drawings in which:

FIGS. 4A, 4B, 4C, 4D, 5A, and 5B are perspective illustrations of a procedure of mounting a handgun in the pistol stabilizer platform, in which:

FIGS. 4A and 4B are simplified perspective illustrations of placing a charging handle accessory on the handgun and the handgun about to be placed in the pistol stabilizer platform.

FIGS. 4C and 4D illustrate the charging handle accessory including side projections that are received in a longitudinal groove formed in the platform member.

FIGS. 5A and 5B are simplified perspective illustrations, respectively before and after closing a mounting fastener of the pistol stabilizer platform that secures the handgun in the pistol stabilizer platform.

DETAILED DESCRIPTION

Figure 3:
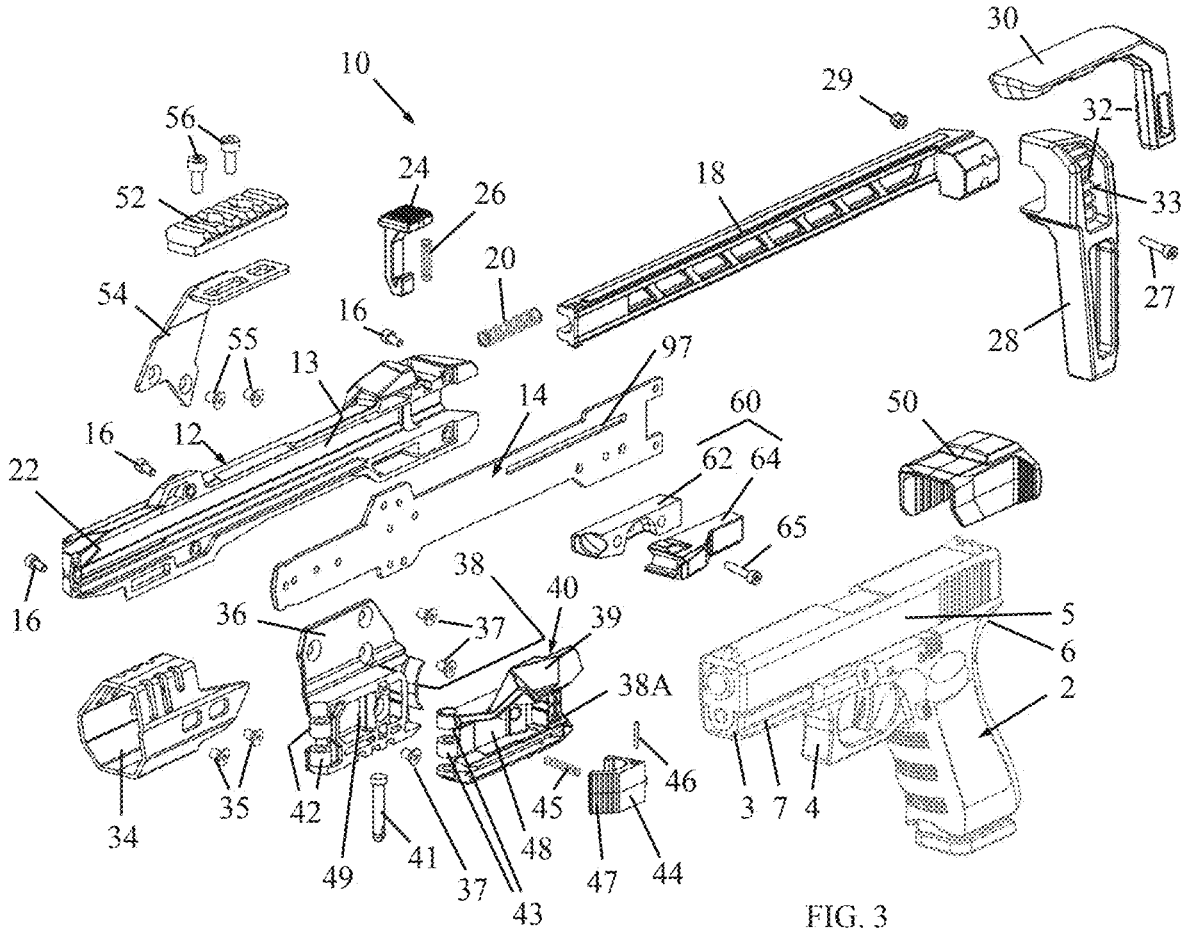
FIG. 3 is a simplified exploded illustration of the pistol stabilizer platform.

Reference is now made to FIG. 3, which is a simplified exploded illustration of the pistol stabilizer platform 10.

As seen more in detail in FIG. 3, pistol stabilizer platform 10 may include a handguard member 12 and a platform member 14. The handguard member 12 may be made, without limitation, from a polymer or other suitable material. The platform member 14 may be made, without limitation, from a metal (e.g., aluminum or steel alloy) or other suitable material. In terms of the shooting direction, handguard member 12 is shown on the outer right side of the pistol stabilizer platform 10 for a right-handed shooter, but can be configured to be on the outer left side of the pistol stabilizer platform 10 for a left-handed shooter. The handguard member 12 can be alternatively constructed to be perfectly symmetrical about its longitudinal axis so that it can be placed on either the outer right or outer left side of the pistol stabilizer platform 10. The platform member 14 may be secured to handguard member 12 by means of one or more fasteners 16.

Figure 1A:
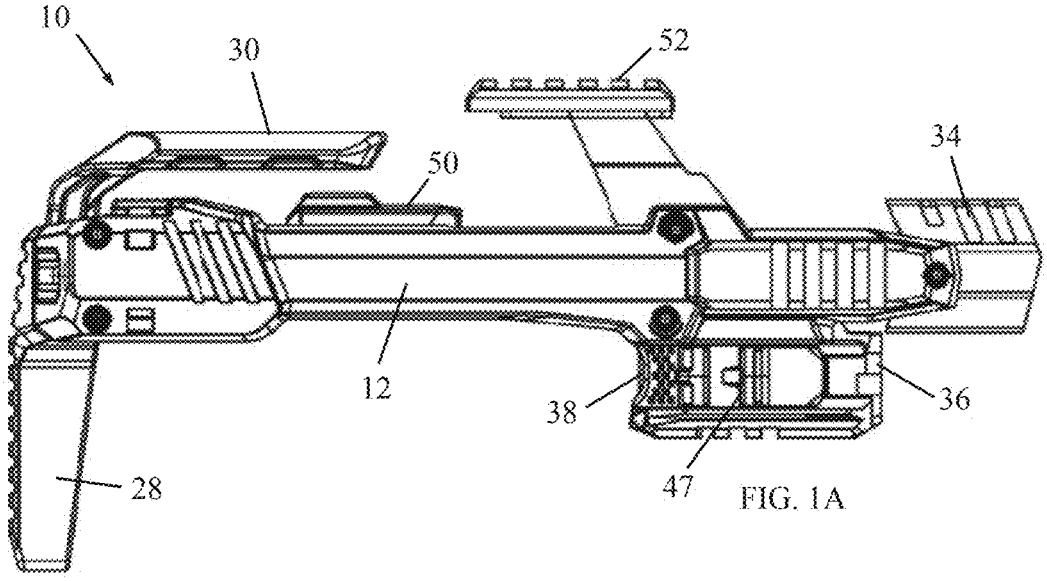
FIGS. 1A, 1B, and 1C are simplified right-side, left-side and right-side perspective illustrations, respectively, of a pistol stabilizer platform, in accordance with a non-limiting embodiment of the present invention.
Figure 1B:
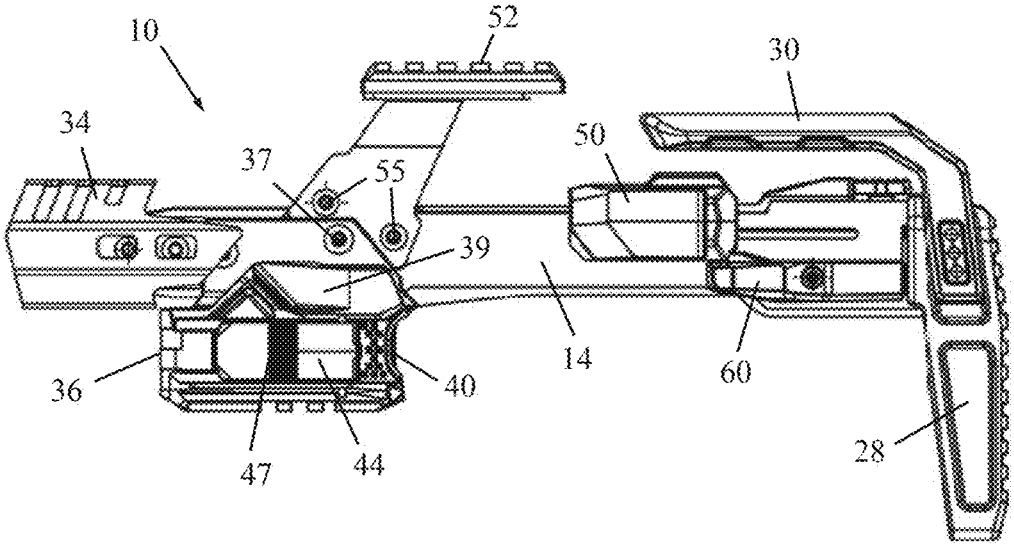
Figure 1C:
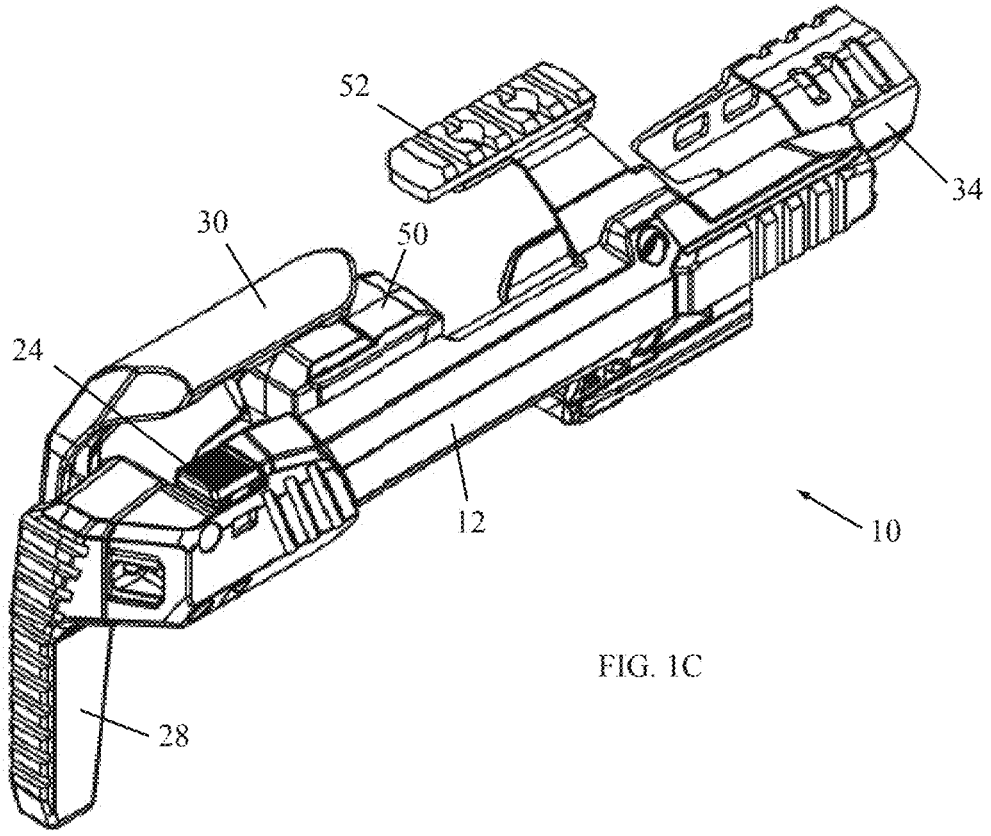
Figure 2A:
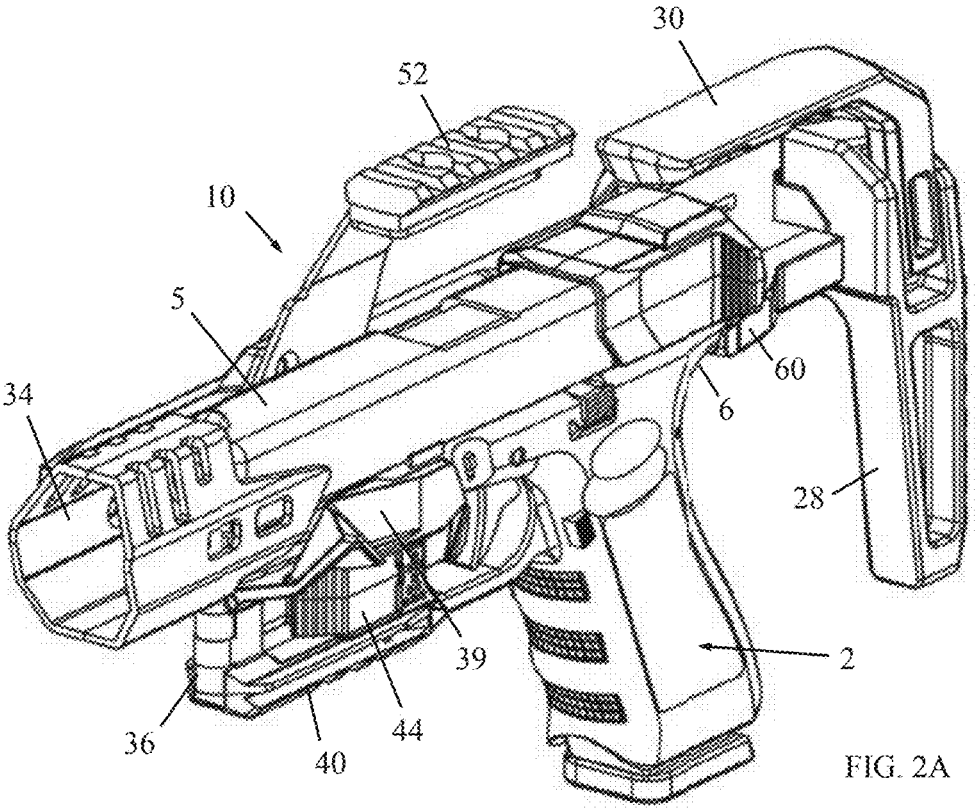
FIGS. 2A and 2B are simplified perspective illustrations of a firearm mounted in the pistol stabilizer platform, with the rear buttstock in respective contracted and extended positions.
Figure 2B:
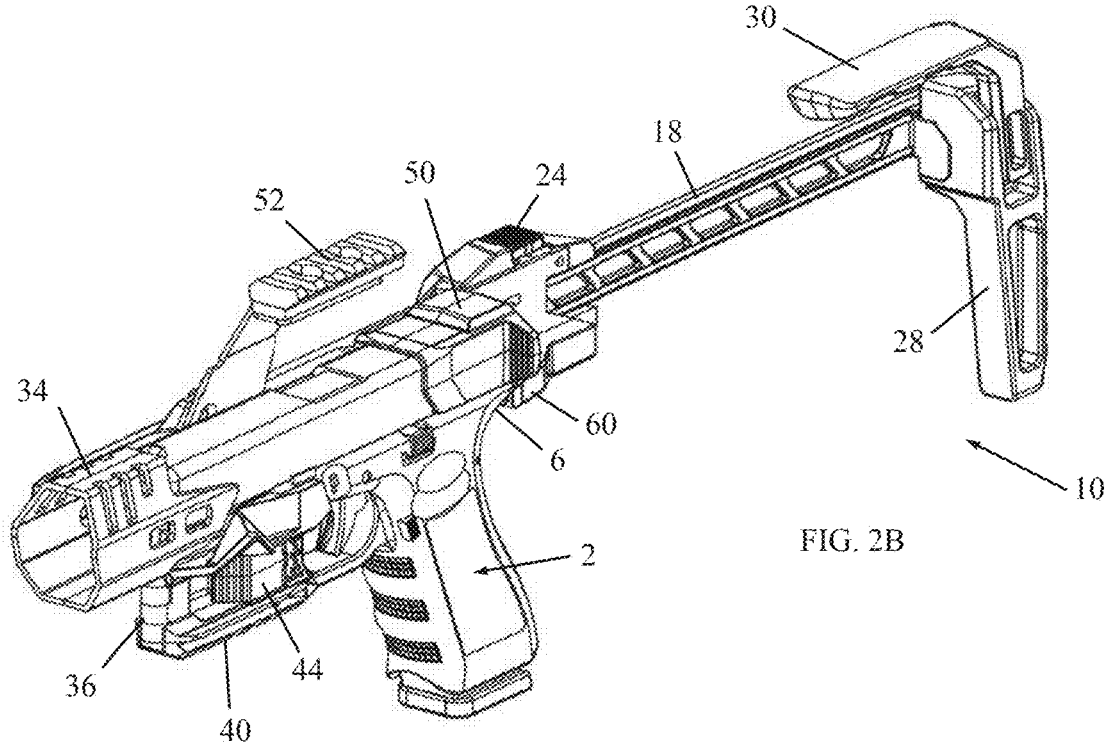

The pistol stabilizer platform 10 may include an extendable rear buttstock rail 18, which is arranged to slide in a channel 13 formed in handguard member 12. Channel 13 is bounded on one side by handguard member 12 and on an opposite side by platform member 14. Buttstock rail 18 may be biased by a first biasing device 20, such as a coil spring, which is placed between the forward end of buttstock rail 18 and an inner far end wall 22 of handguard member 12. A buttstock rail catch 24 may be provided to maintain buttstock rail 18 in the contracted position (in which first biasing device 20 is completely compressed), the contracted position being shown in FIG. 2A. The buttstock rail catch 24 may be biased by a second biasing device 26, such as a coil spring, which keeps catch 24 in the locked position that maintains buttstock rail 18 in the contracted position. The second biasing device 26 urges catch 24 upwards (in the sense of the drawing) so that the bottom lip of catch 24 abuts against and holds buttstock rail 18 in position. When catch 24 is pressed against second biasing device 26, catch 24 releases its hold on buttstock rail 18, so that first biasing device 20 applies a force on buttstock rail 18 to push it to its extended position (shown in FIG. 2B).

Buttstock rail 18 may include a butt heel 28 (also called butt pad 28), which may be fastened thereto by a screw 27 and nut 29. Buttstock rail 18 may include a check rest 30 (also called jaw rest 30), which may be coupled to butt heel 28 by means of male-female connections 32 formed on check rest 30 and in a recess 33 of butt heel 28.

The pistol stabilizer platform 10 may include a forward handgun guard member 34, which may be fastened to platform member 14 by one or more screws 35.

The pistol stabilizer platform 10 may include a distal (i.e., forward) fastening flange 36, which be fastened to platform member 14 by one or more screws 37. The fastening flange 36 may include a trigger guard abutment member 38. The fastening flange 36 is configured to be mounted below a receiver 3 and in front of a trigger guard 4 of a handgun 2. The front end of handgun 2, including its slide or barrel 5, when mounted in pistol stabilizer platform 10, is received in the hollow portion of forward handgun guard member 34 and trigger guard 4 abuts against trigger guard abutment member 38. A clasp member 40 may be hinged to fastening flange 36, such as by means of a hinge pin 41 that passes through hinge members 42 and 43 formed on fastening flange 36 and clasp member 40, respectively. The fastening flange 36 and the clasp member 40 form a forward handgun clasping assembly which is coupled to platform member 14. A spring-loaded clasp 44 (biased by a spring 45) may be hinged to clasp member 40 by a pin 46. The spring-loaded clasp 44 has an edge grip 47 that can pass through an aperture 48 of clasp member 40 to click on and be locked on a rim 49 of fastening flange 36.

The clasp member 40 may also include a receiver clasp 39 pivoted to the body of clasp member 40. When handgun 2 is mounted in pistol stabilizer platform 10, the receiver clasp 39 may be pivoted to lock into a groove 7 formed on the receiver 3 of handgun 2. This may help to firmly hold the handgun 2 in place in pistol stabilizer platform 10. The clasp member 40 may also include a trigger guard abutment member 38A.

A charging handle accessory 50 may be provided for attachment to the slide 5 of handgun 2. For example, without limitation, charging handle accessory 50 may be simply placed over slide 5 and is held in place by serrations that match the serrations of slide 5. As seen in FIGS. 4C and 4D, charging handle accessory 50 may include one or more side projections 95 that are received in a longitudinal groove 97 formed in platform member 14. The longitudinal groove 97 serves as a guide for guiding the linear movement of the charging handle accessory 50 when the user pulls the charging handle accessory 50 to manually charge the handgun or eject an unfired round.

A firearms accessories rail member 52 (such as a Picatinny rail member) may be secured to a flange 54, which may be fastened to platform member 14 by one or more screws 55. The firearms accessories rail member 52 may be secured to flange 54 by one or more screws 56.

A rear grip abutment member 60 may be secured to platform member 14 by one or more screws 65. Rear grip abutment member 60 may be a one-piece construction, or may be constructed of two portions 62 and 64. When handgun 2 is mounted in pistol stabilizer platform 10, rear grip (or beaver tail) 6 of handgun 2 abuts against and is received in rear grip abutment member 60.

It is noted that platform member 14 has multiple mounting provisions (such as multiple mounting holes) so that fastening flange 36, with its trigger guard abutment member 38, and rear grip abutment member 60 can be adjusted to accommodate many models of handguns.

Reference is now made to FIGS. 1A, 1B, 1C, 2A, and 2B, which show the relative positions of all the parts of pistol stabilizer platform 10 as described above.

Reference is now made to FIGS. 4A, 4B, 5A, and 5B, which are perspective illustrations of a procedure of mounting the handgun 2 in the pistol stabilizer platform 10. In FIGS. 4A and 4B, the charging handle accessory 50 is placed on the handgun 2.

The handgun 2 is about to be placed in the pistol stabilizer platform 10.

Figure 5A:
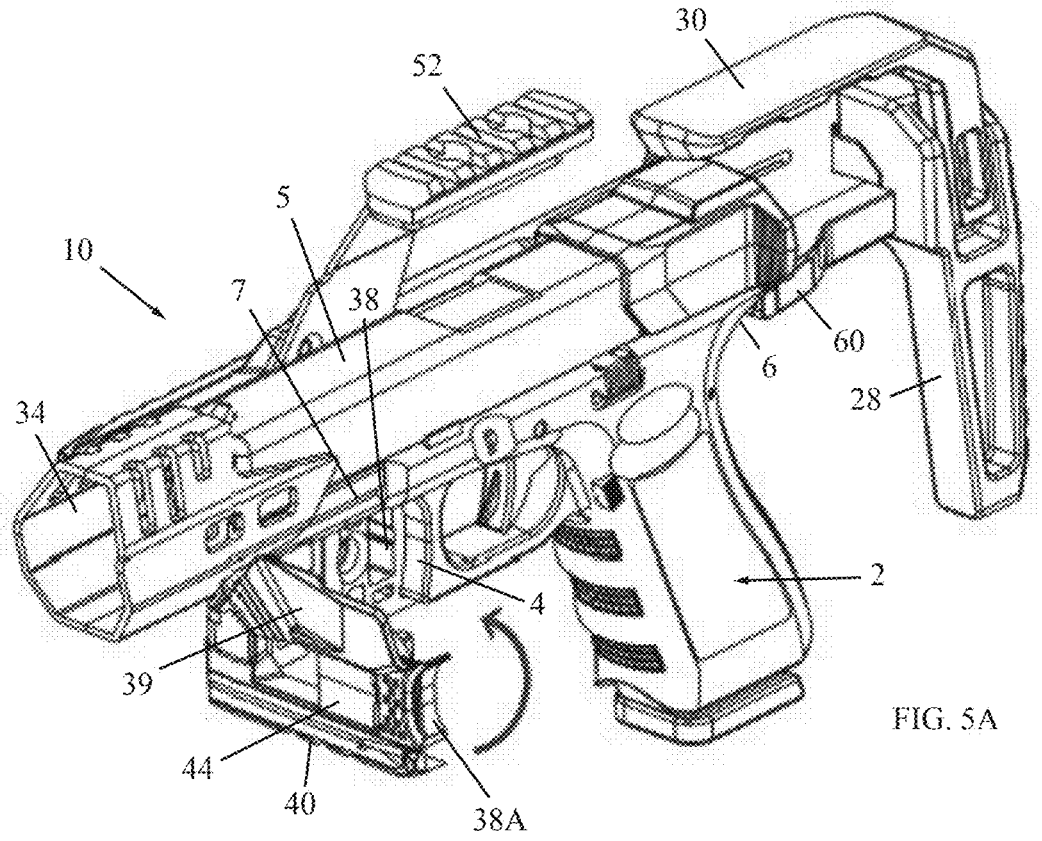
Figure 5B:
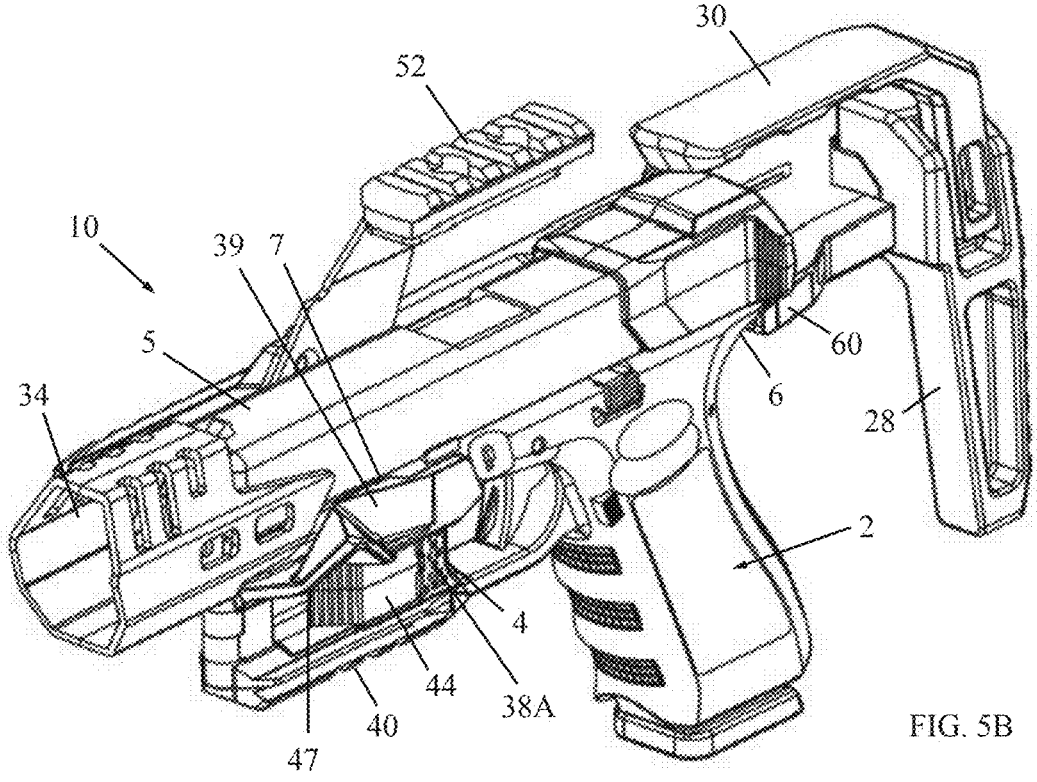

In FIGS. 5A and 5B, the front end of handgun 2, including its slide 5, after being mounted in pistol stabilizer platform 10, is received in the hollow portion of forward handgun guard member 34 and trigger guard 4 abuts against trigger guard abutment members 38 and 38A. After handgun 2 is mounted in pistol stabilizer platform 10, rear grip (or beaver tail) 6 of handgun 2 abuts against and is received in rear grip abutment member 60. After handgun 2 is mounted in pistol stabilizer platform 10, the receiver clasp 39 may be pivoted to lock into groove 7 formed on the receiver 3 of handgun 2. This may help to firmly hold the handgun 2 in place in pistol stabilizer platform 10.

The pistol stabilizer platform 10 is asymmetrical, that is one-sided, meaning all of the elements that maintain the handgun 2 in a secure position for firing are all coupled to platform member 14 which is on one side of the handgun 2. The buttstock rail 18 and butt heel 28 are also on that same side of the handgun 2 and are indirectly coupled via handguard member 12 to platform member 14. This one-sided construction is thus open-faced (meaning the platform member 14 is readily accessible for mounting items like adapters) and not closed like prior art stabilizers. The one-sided, open-faced construction makes the pistol stabilizer platform 10 very easy to adapt to and accommodate many models of handguns (as opposed to the closed platforms of the prior art which are more complicated to adapt to different models of handguns). Additionally or alternatively, as mentioned above, platform member 14 has multiple mounting provisions to accommodate many models of handguns. Additionally or alternatively, the forward handgun clasping assembly and the rear grip abutment member may be parts of an assortment of different forward handgun clasping assemblies and rear grip abutment members structured to accommodate different models of handguns.

Figure 6A:
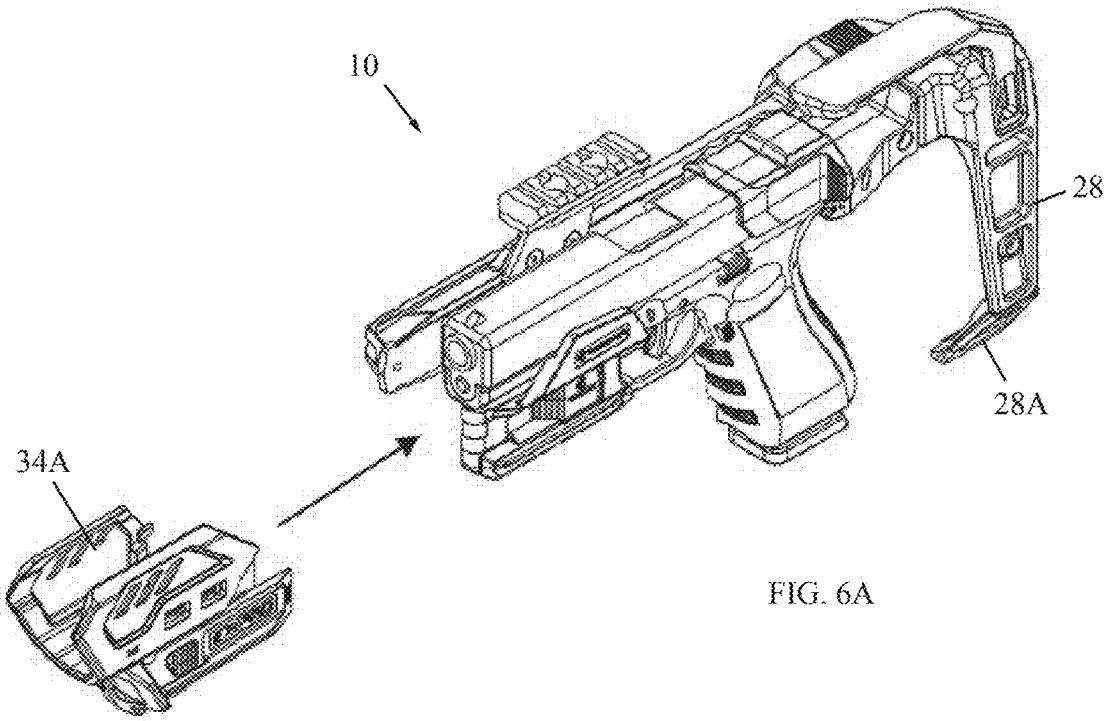
FIGS. 6A and 6B are simplified perspective illustrations, respectively before and after mounting a different style forward handgun guard member on to the pistol stabilizer platform. The stabilizer platform is also shown with a different style butt heel.
Figure 6B:
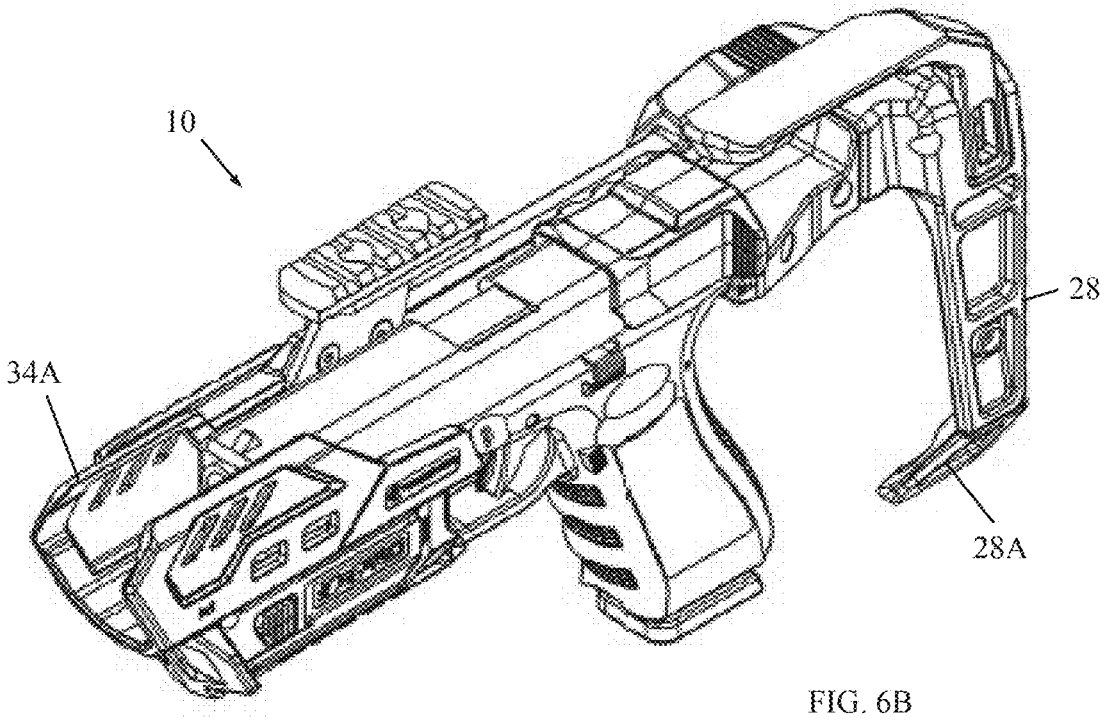

Reference is made to FIGS. 6A and 6B, which illustrate mounting a different style forward handgun guard member 34A on to the pistol stabilizer platform 10. As opposed to the closed-contour forward handgun guard member 34 shown above, forward handgun guard member 34A is open, such as being open at the upper portion (in the sense of the drawings), so it can be mounted on the platform after the handgun is secured in place. The stabilizer platform 10 is also shown here with a different style butt heel 28, which has a lower appendage 28A that is tilted inwards, which may provide a snugger hold on the shooter's arm.

The invention claimed is:

1. A pistol stabilizer platform comprising:

a platform member comprising multiple mounting provisions;

a forward handgun clasping assembly secured to said platform member at a first one of said multiple mounting provisions, said forward handgun clasping assembly being configured to secure a forward portion of a handgun placed in said pistol stabilizer platform and to abut against a trigger guard of the handgun; and a rear grip abutment member secured to said platform member at a second one of said multiple mounting provisions, said rear grip abutment member being configured to secure a rear portion of the handgun placed in said pistol stabilizer platform, and wherein said platform member is located only on one side of the handgun placed in said pistol stabilizer platform; and further comprising an extendable rear buttstock rail arranged to slide in a channel bounded on one side thereof by said platform member.

2. The pistol stabilizer platform according to claim 1, wherein said forward handgun clasping assembly and said rear grip abutment member are movable to different positions among said multiple mounting provisions to accommodate different models of handguns.

3. The pistol stabilizer platform according to claim 1, wherein said forward handgun clasping assembly and said rear grip abutment member are parts of an assortment of different forward handgun clasping assemblies and rear grip abutment members structured to accommodate different models of handguns.

4. The pistol stabilizer platform according to claim 1, further comprising a forward handgun guard member secured to said platform member and configured to receive a portion of a slide or barrel of said handgun.

5. The pistol stabilizer platform according to claim 1, further comprising a charging handle accessory for attachment to a slide of said handgun.

6. The pistol stabilizer platform according to claim 5, wherein said charging handle accessory comprises a side projection received in a longitudinal groove formed in said platform member.

7. The pistol stabilizer platform according to claim 1, further comprising a firearms accessories rail member secured to a flange which is secured to said platform member.

8. The pistol stabilizer platform according to claim 1, wherein said buttstock rail comprises a butt heel.

9. The pistol stabilizer platform according to claim 8, wherein said buttstock rail comprises a cheek rest.

10. The pistol stabilizer platform according to claim 1, wherein a spring-loaded buttstock rail catch maintains said buttstock rail in a contracted position, said spring-loaded buttstock rail catch being releasable to allow said buttstock rail to move to an extended position.

* * * * *